US007107943B2

(12) United States Patent
Yasuda et al.

(10) Patent No.: US 7,107,943 B2
(45) Date of Patent: Sep. 19, 2006

(54) ENGINE-DRIVEN OPERATING MACHINE

(75) Inventors: Hitoshi Yasuda, Kawagoe (JP); Satoshi Kojima, Kawagoe (JP)

(73) Assignee: Denko Kabushiki Kaisha, Tokyo-To (JP)

( * ) Notice: Subject to any disclaimer, the term of this patent is extended or adjusted under 35 U.S.C. 154(b) by 0 days.

(21) Appl. No.: 11/050,650

(22) Filed: Feb. 4, 2005

(65) Prior Publication Data

US 2006/0054113 A1 Mar. 16, 2006

Related U.S. Application Data

(63) Continuation-in-part of application No. 10/943,223, filed on Sep. 17, 2004, now abandoned.

(30) Foreign Application Priority Data

Sep. 15, 2004 (JP) ..... 2004-268763

(51) Int. Cl.
*G10K 11/04* (2006.01)

(52) U.S. Cl. ..... 123/41.62; 123/41.49

(58) Field of Classification Search ..... 123/41.49, 123/41.51, 41.56, 41.62, 41.65, 198 E
See application file for complete search history.

(56) References Cited

U.S. PATENT DOCUMENTS 3,949,727 A * 4/1976 Thien et al. ..... 123/198 E
4,241,702 A * 12/1980 Takeuchi et al. ..... 123/41.7
4,883,024 A * 11/1989 Ito et al. ..... 123/41.7
5,007,383 A * 4/1991 Ito et al. ..... 123/41.49
5,731,687 A * 3/1998 Hirano et al. ..... 322/1
2002/0000342 A1* 1/2002 Yamada et al. ..... 181/204

FOREIGN PATENT DOCUMENTS

JP 08-261008 10/1996
JP 2002004857 1/2002

* cited by examiner

*Primary Examiner*—Stephen K. Cronin
*Assistant Examiner*—Jason Benton
(74) *Attorney, Agent, or Firm*—Jacobson Holman PLLC

(57) ABSTRACT

A soundproof engine-driven operating machine has a small installation area, is easy to assemble and disassemble, and has superior cooling effects. The soundproof engine-driven operating machine includes an engine, an operating machine main body that is driven by the engine, a base frame that supports the engine and the operating machine main body in a vibration-proof structure, and a case fitted to the base frame and accommodating the engine and the operating machine main body. One part of the case includes a first-story chamber accommodating the engine and the operating machine main body, first and second heat exchangers, each having a cooling fan and being arranged above the first-story chamber, the first and second heat exchangers performing heat conversion relating to the operation of the engine by using the cooling fans, arranged separately in a ventilation path, and a second-story chamber accommodating a muffler for discharging engine air. The part of the case is formed from a structural frame that is provided on the base frame. A cover is secured to the base frame, and covers the entire structural frame.

7 Claims, 13 Drawing Sheets

ENGINE-DRIVEN OPERATING MACHINE

This is a continuation-in-part of U.S. Ser. No. 10/943,223 filed Sep. 17, 2004 now abandoned.

BACKGROUND OF THE INVENTION

1. Field of the Invention

The present invention relates to an engine-driven operating machine that uses an engine to drive an electric generator, a compressor, a pump, and the like, and in particular, relates to an engine-driven operating machine that has been made soundproof.

2. Description of the Related Art

This type of engine-driven operating machine is installed on a base, forming a foundation, and is housed in a soundproof case. The soundproof engine-driven operating machine should preferably have a small installation area and a simple structure, while being easy to assemble and disassemble and having superior soundproofing characteristics.

FIGS. 11 and 12 show an example of this type of engine-driven operating machine. In this example, disclosed in Laid-open Japanese Patent Application No. 1996-261008, an air-cooled engine E and a generator G, that is connected to the engine E by a belt 214, are installed via rubber isolators 215 on a bearing plate 212, provided on a mounting board 206.

An inside case 202 is fitted on the mounting board 206 with rubber isolators 207 in between. Rubber isolators 208 are affixed to the top face of a ceiling plate 204 of the inside case 202, and an outside case 203 is fitted outside them. Bottom ends of the outside case 203 are secured to securing tools 216, that are secured to the mounting board 206 by tightening screws 217.

This obtains a double-layer case 201 having inside and outside cases, that shut off noise generated by internal devices. Sound transmission between the inside case 202 and the outside case 203 is thereby prevented.

FIG. 13 shows another conventional constitution. This constitution is disclosed in Laid-open Japanese Patent Application No. 2002-4857, and includes an assemble-type soundproof case. The framework of a soundproof case K includes a front frame 321, a rear frame 331, and an unillustrated center frame, that are assembled on a base.

The inside of the soundproof case K is partitioned into an engine chamber 301, a muffler chamber 302, and a radiator chamber 303. The engine chamber 301 contains an engine E and a operating machine main body G, the muffler chamber 302 contains a muffler, and the radiator chamber 303 contains an unillustrated radiator. A plurality of unillustrated wind outlet holes are provided in the side walls of the radiator chamber 303, a wind inlet hole is provided in the muffler chamber 302, and the muffler chamber 302 and the radiator chamber 303 are joined together.

In this constitution, cooling wind that cools the engine chamber 301 is sucked in from wind inlet holes 331*a* and 335*a* by an axle-driven engine fan. After cooling the inside of the engine chamber 301, the cooling wind passes through the engine fan and cools an unillustrated intercooler, passes via a ventilation duct 304 to the muffler chambers 302A and 302B, where it cools the muffler and is then discharged into the atmosphere.

An unillustrated wind inlet hole is formed in the front left side wall (as viewed in FIG. 8) of the radiator chamber 303 inside the front frame 321, the radiator being provided on a wall face opposite the wind inlet hole. An electrically powered fan faces the radiator between the wind inlet hole and the radiator, and fans the cooling wind into the muffler chamber 302B.

The electrically powered fan sends the cooling wind through a special spherical wind hole, formed in the radiator chamber 303. After cooling the radiator, the cooling wind is sent into the muffler chamber 302B and discharged into the atmosphere from a wind outlet hole, formed in the ceiling of the muffler chamber 302B.

The conventional example shown in FIG. 8 is disclosed as a soundproof case having a low-noise structure that increases cooling efficiency by arranging separate heat exchangers along the path of the cooling wind.

Although the conventional example shown in FIGS. 6 and 7 has superior soundproofing effects, the two cases must be removed in order to inspect the inside, which is troublesome. The structure becomes particularly complex and unsuitable for miniaturization in the case of large-scale device or the like, or a case where the apparatus required for operation is installed outside the engine or the operating machine main body.

The conventional example shown in FIG. 8 succeeds in providing a engine-driven operating machine that is quiet and has good cooling capability, but its length is difficult to shorten since the operating machine main body, the engine, the engine fan, the intercooler, and the cooling duct, are arranged in a straight line. Since the soundproof case is a collective body formed by joining primary members, its structure is complex and expensive, and it is time-consuming to assemble and disassemble.

SUMMARY OF THE INVENTION

The present invention has been realized in consideration of the points mentioned above, and aims to provide a soundproof engine-driven operating machine that is easy to assemble, has a small floor area, and superior cooling effects.

In order to achieve the above objects, the soundproof engine-driven operating machine of this invention includes an engine, a operating machine main body that is driven by the engine, a base frame that supports the engine and the operating machine main body in a vibration-proof structure, and a case that is fitted to the base frame and accommodates the engine and the operating machine main body.

One part of the case includes a first-storey chamber that accommodates the engine and the operating machine main body, first and second heat exchangers, each having a cooling fan and being arranged above the first-storey chamber, the first and second heat exchangers performing heat conversion relating to the operation of the engine by using the cooling fans, arranged separately in a ventilation path, and a second-storey chamber that accommodates a muffler for discharging engine air. The part of the case is comprised from a structural frame that is provided on the base frame.

The first-storey chamber and the second-storey chamber are connected by a ventilation path that supplies cooling wind for the second heat exchanger from the first-storey chamber. The second-storey chamber has a ventilation path that discharges cooling winds, that have passed through the first and second heat exchangers and cooled the muffler, to the outside.

As described above, according to this invention, one part of the case is comprised from a structural frame, provided on the base frame, the engine and the operating machine main body are arranged in the first-storey chamber, and the heat exchangers and the muffler are arranged in the second-storey chamber. Cooling wind is passed through the first-storey chamber and the second-storey chamber, being guided from the first-storey chamber to the second-storey chamber so as to achieve comprehensive ventilation by cooling wind. Therefore, this invention can provide the soundproof engine-driven operating machine that is small, easy to assemble and disassemble, and has superior cooling effects.

DETAILED DESCRIPTIONS OF THE PREFERRED EMBODIMENTS

Preferred embodiments of this invention will be explained with reference to FIGS. 1 to 5.

Figure 1:
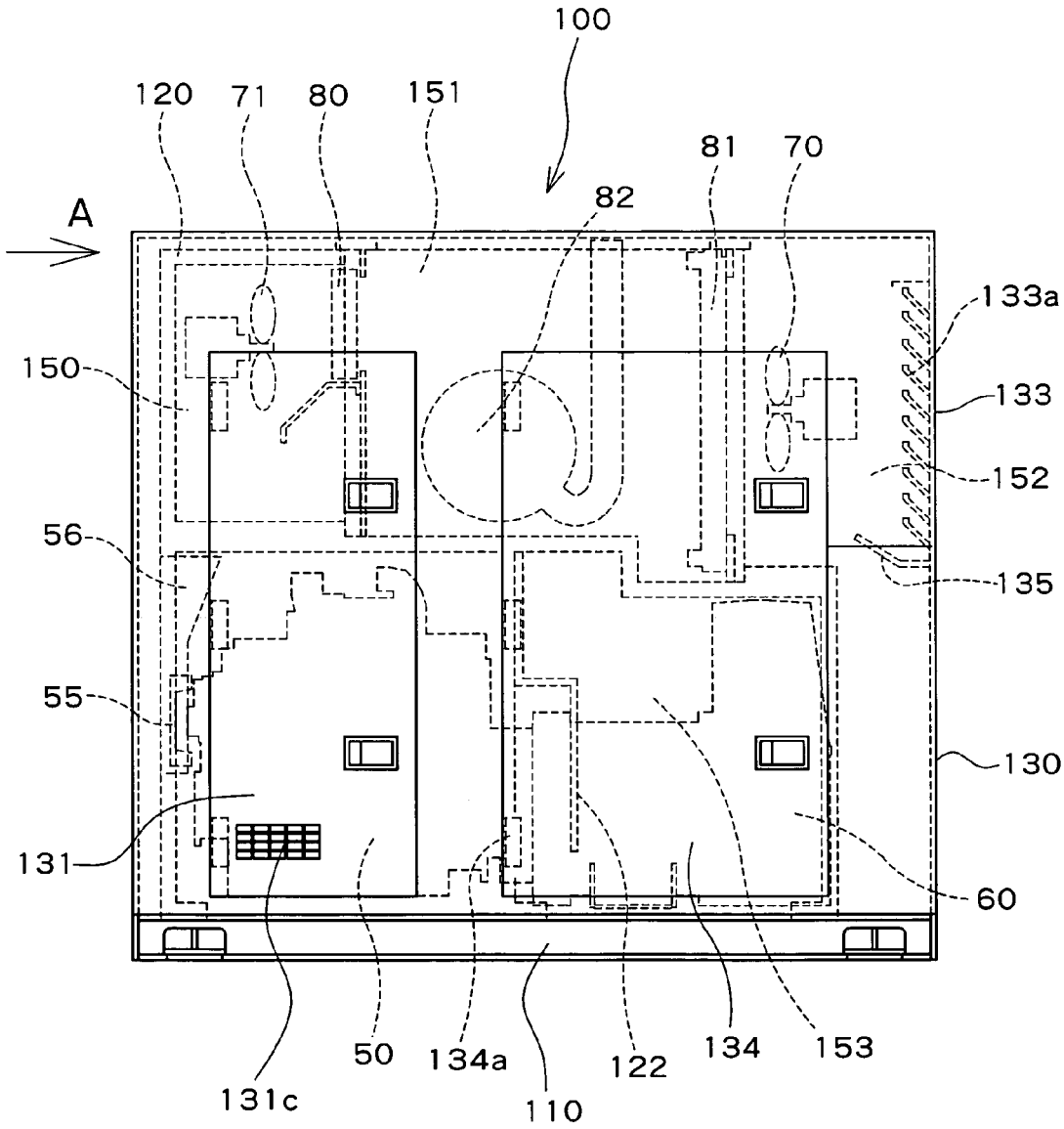
FIG. 1 is a side view of the constitution of an embodiment of this invention.
Figure 2:
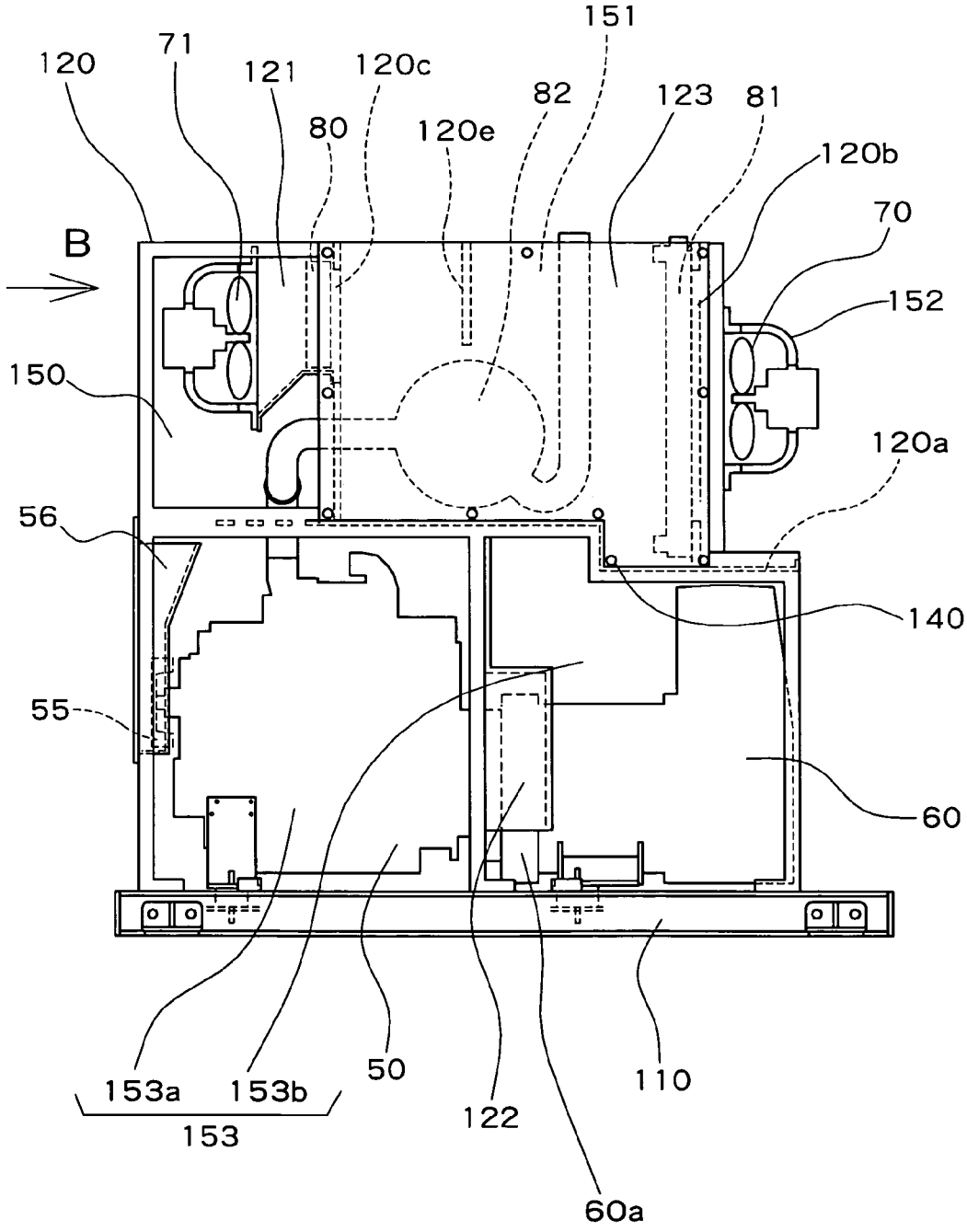
FIG. 2 is a side view of the embodiment of FIG. 1 when a cover is removed.

FIG. 1 shows the side face shape of a first embodiment, and FIG. 2 shows the side face shape of the first embodiment when a cover, that forms part of a case, is removed. The first embodiment will be explained based on FIGS. 1 and 2.

The engine-driven operating machine according to this invention is assembled on a base 110, an engine 50 and a operating machine main body 60 being attached to the base 110 with unillustrated rubber isolators in between.

The case has a two-storey structural frame 120 and a cover 130.

The two-storey structural frame 120 is detachably secured to the base 110, and covers the engine 50 and the operating machine main body 60. The structural frame 120 has a two-storey structure, so that components required for operation can be provided above the engine 50 and the operating machine main body 60. A floor plate 120*a* is provided on the floor of the second-storey, and also functions as a dividing plate with the first floor, in which the engine 50 and the operating machine main body 60 are installed, thereby separating the case into a first-storey chamber and a second-storey chamber.

The second-storey chamber is broadly partitioned into three sections. A muffler 82 is provided in the center, a first heat exchanger 81 is provided on the right side of FIGS. 1 and 2, and a second heat exchanger 80 is provided on the left side. The heat exchangers 81 and 80 comprise, for example, radiators, intercoolers, or the like, and respectively include cooling fans 70 and 71 that cool cooling water or intake air. The cooling fans 70 and 71 may be operated together or separately.

The second-storey chamber includes a central muffler section 151, a first heat exchanger section 152 on the right side of FIGS. 1 and 2, and a second heat exchanger section 150 on the left side. A vertical partition 120*c* separates the muffler section 151 and the second heat exchanger section 150, and a vertical partition 120*b* separates the muffler section 151 and the first heat exchanger section 152.

The first heat exchanger 81 is installed on the muffler section 151 side face of the vertical partition 120*b*. The section shown in FIGS. 1 and 2 on the right side of the vertical partition 120*b* including the first heat exchanger 81 is termed the first heat exchanger section 152. A through hole is provided in the installation face of the first heat exchanger 81 on the vertical partition 120*b*, and connects the first heat exchanger section 152 to the muffler section 151.

The first cooling fan 70 is installed in the first heat exchanger section 152, and faces the vertical partition 120*b*. The muffler 82 is provided in the muffler section 151. The vertical partitions 120*b* and 120*c*, and a side cover 123 that covers from both sides the portion of the channel adaptor unit 120 that corresponds to the muffler section 151, are provided in the muffler section 151, and are detachably secured by bolts 140.

Arranged in this manner, the muffler section 151 forms a space that is open at the top, while its bottom face and four corners are surrounded by the vertical partitions. A wind outlet guide plate 120*e* is provided at the top of the inside of the muffler section 151, and divides and discharges cooling winds from the left and right sides of FIGS. 1 and 2 in the muffler section 151 (i.e. cooling wind from the first heat exchanger section 152 and cooling wind from the second heat exchanger section 150).

The muffler section 151 directs cooling wind, that has passed through all the internal sections of the structural frame 120, toward the top of FIGS. 1 and 2, and discharges it from a wind outlet that is opened in the cover 130. The area between the top of the muffler section 151 and the wind outlet is reliably sealed by a flexible member 83 that surrounds the periphery of the wind outlet, from where the wind is discharged into the atmosphere. The exhaust wind is discharged to the outside without flowing back into the device, obtaining a superior cooling effect.

Inside the second heat exchanger section 150, a duct 121 is fitted to the vertical partition 120*c*, and the second heat exchanger 80 is fitted on a face of the vertical partition 120*c* inside the duct 121. A through hole is opened in the installation face of the second heat exchanger 80 on the vertical partition 120*c*, and connects the second heat exchanger section 150 to the muffler section 151.

The left end (as viewed in FIGS. 1 and 2) of the duct 121 in the second heat exchanger section 150 is an intake hole for cooling wind, and the second cooling fan 71 is fitted to this intake hole. Wind that cooled the engine chamber 153 is sent through a ventilation duct 56 to the second heat exchanger section 150 at the top. Instead of a normal axis-driven fan, the engine fan of the engine 50 comprises a centrifugal fan, that is fitted at the lower end of the ventilation duct 56. The axial direction thickness of the engine fan, contained in the ventilation duct 56, is approximately the same as, or slightly thicker than, the thickness of the engine fan. The ventilation duct 56 is detachably secured to a side wall of the structural frame 120 by unillustrated bolts.

By partitioning the second storey of the structural frame 120 into three sections in this manner, the cooling fans 71 and 70 can cool the two second heat exchanger sections 150 and 152 separately, making the cooling highly efficient. Since the cooling fans 71 and 70 can be operated separately, cooling is highly efficient.

In the engine chamber 153 in the first storey of the structural frame 120, a dividing plate 122 separates an engine container 153*a*, that is a noise source including the engine 50 and a wind outlet 60*a* of a generator 60, from a generator container 153*b*, that is a non-noise source. The dividing plate 122 is secured to the structural frame 120 by unillustrated bolts.

The dividing plate 122 partitions the engine container 153*a* and the generator container 153*b*, reducing noise by restricting noise transmission. In addition, cooling wind that passes below the dividing plate 122 efficiently cools the oil pan at the base of the engine.

The base 110 supports the engine 50 and the generator 60 in a vibration-proof structure, and the structural frame 120 that covers the engine 50 and the generator 60 is detachably secured to the base 110. Devices that are required for operation are installed in the second storey of the structural frame 120. Accordingly, a soundproof engine-driven operating machine having a small floor area can be provided.

The cover 130 is placed over the structural frame 120 onto the base 110, and the bottom part of the cover 130 is detachably secured to the top face of the base 110 by unillustrated bolts.

An intake hole 133 has diagonal plates 133*a* that reduce rainwater seepage, and is formed in the side wall of the cover 130 at the top right side of FIG. 1, thereby diverting rainwater and allowing only air to enter. A total of three doors 131 for preventive inspection of the inside are rotatably provided in the side walls of the cover 130. The doors 131 have a double-layer structure in which the inside is a ventilation path. Intake holes 131*c* for taking in outside air are formed on the bottom side of the outer face of each door 131, and send cooling wind directly to the second heat exchanger section 150 via an unillustrated internal ventilation path 131*d*. A total of two doors 134 are provided, one on each side of the cover 130, and have a single-layer structure wherein their inner faces on the engine chamber 153 side are filled with soundproofing material.

The cover 130 can easily be removed when repairing or exchanging large components and the like, facilitating preservative inspection. Doors are provided at predetermined positions in the cover 130, so that the inside can be easily inspected at the time of inspection.

Figure 3:
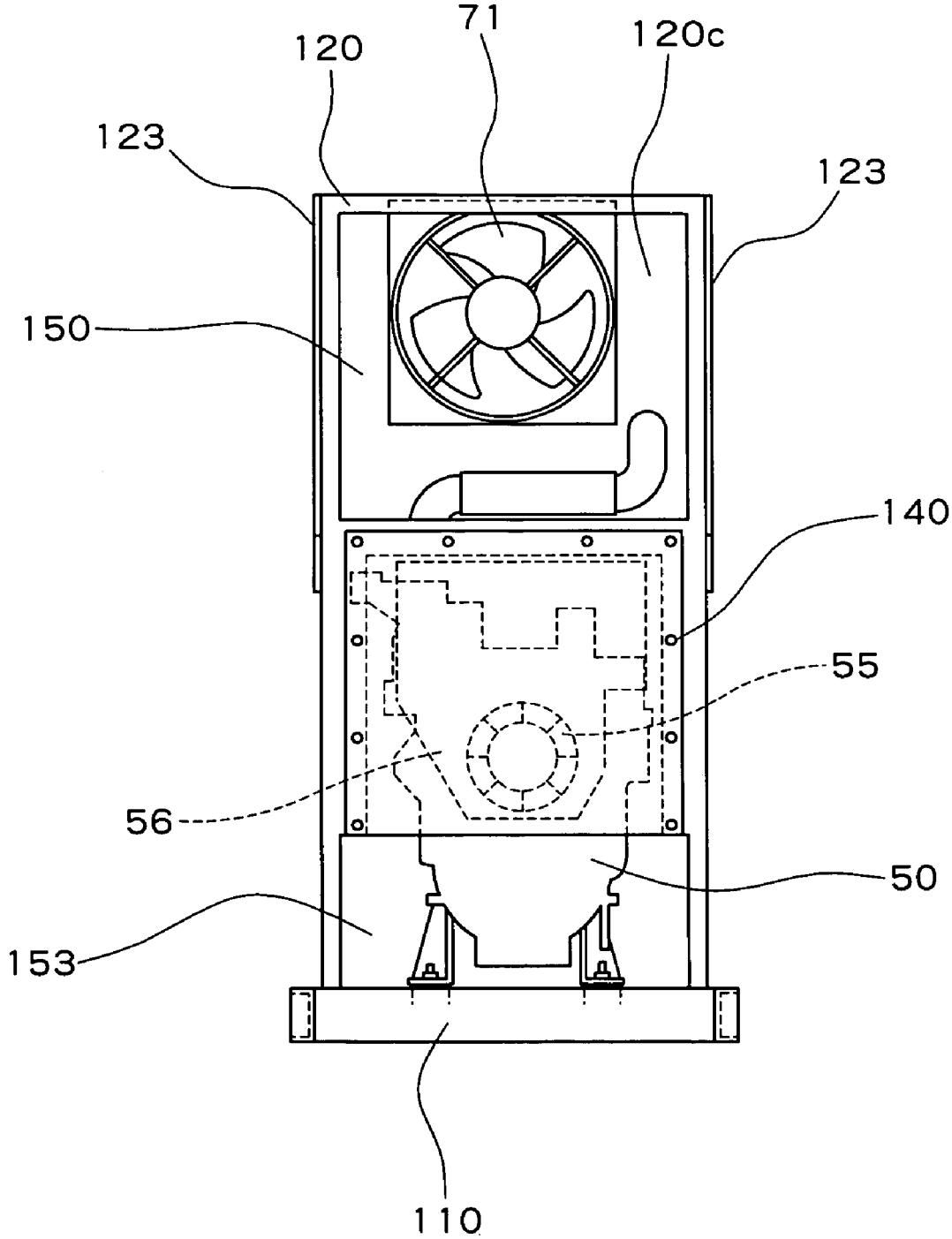
FIG. 3 is a view from direction B of FIG. 2.

FIG. 3 is a diagram of the engine 50, the generator 60, and the structural frame 120, that are secured to the base 110 shown in FIG. 2, viewed from direction B of FIG. 2. As shown in FIG. 3, the ventilation duct 56 has intake holes that surround an engine fan 55, and is detachedly secured by a plurality of bolts 140 to the side wall face of the structural frame 120. The ventilation duct 56 connects the engine chamber 153 to the second heat exchanger section 150.

The engine fan 55 is a centrifugal fan that sends the air in the engine chamber 153 along the ventilation duct 56 to the second heat exchanger section 150.

Figure 4:
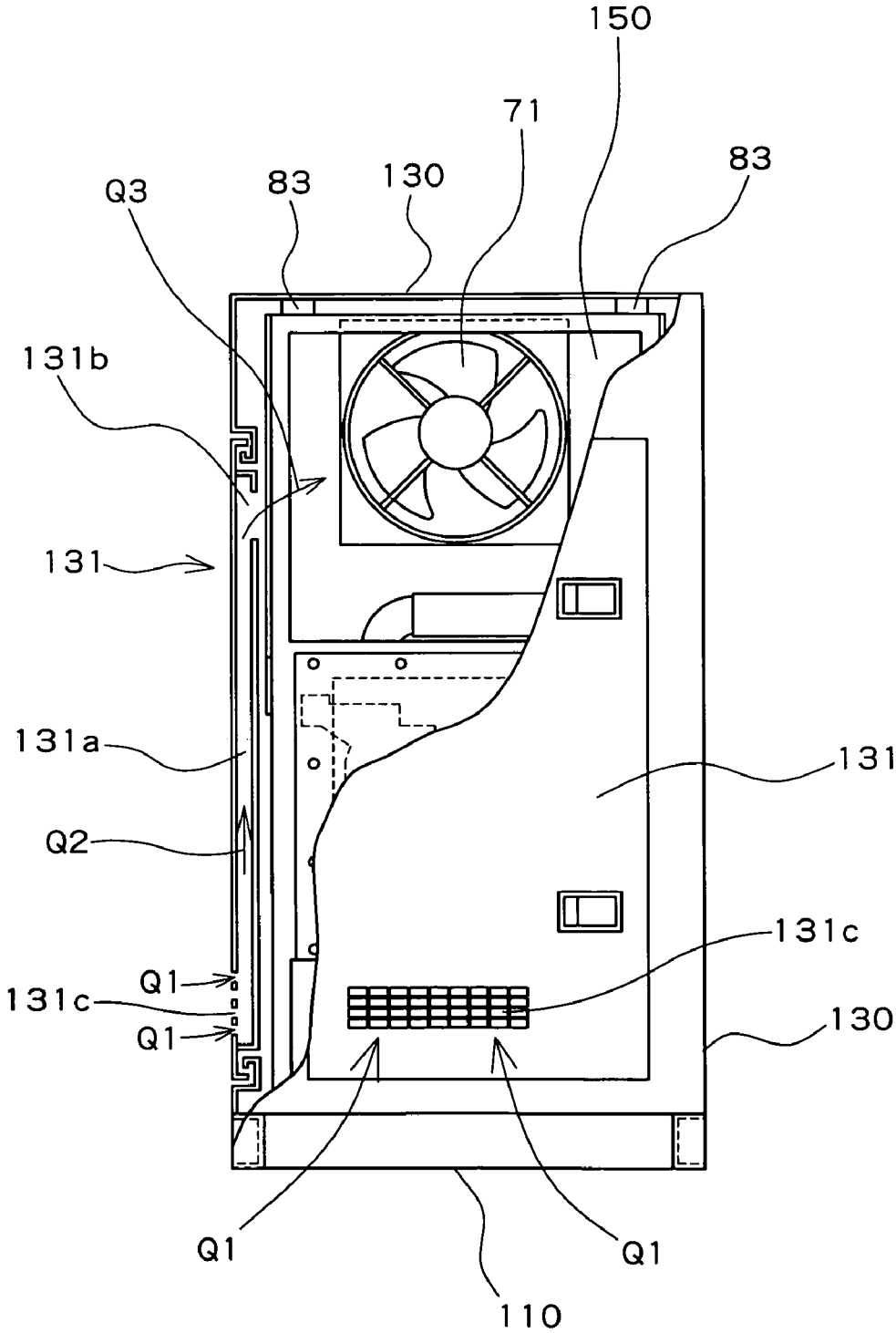
FIG. 4 is a view from direction A of FIG. 1.

FIG. 4 is a view from direction A of FIG. 1. The doors 131 are formed in a double-layer structure with the ventilation path 131*a* inside, and have intake holes 131*c* at the bottom of their outer wall faces. Cooling wind is fed in through the intake holes 131*c* by the second cooling fan 71, becoming flows Q1, Q2, and Q3, and is fed into the second heat exchanger section 150 from a connecting hole 131*b* in the inner wall face of the top end of the ventilation path 131*a*.

Figure 5:
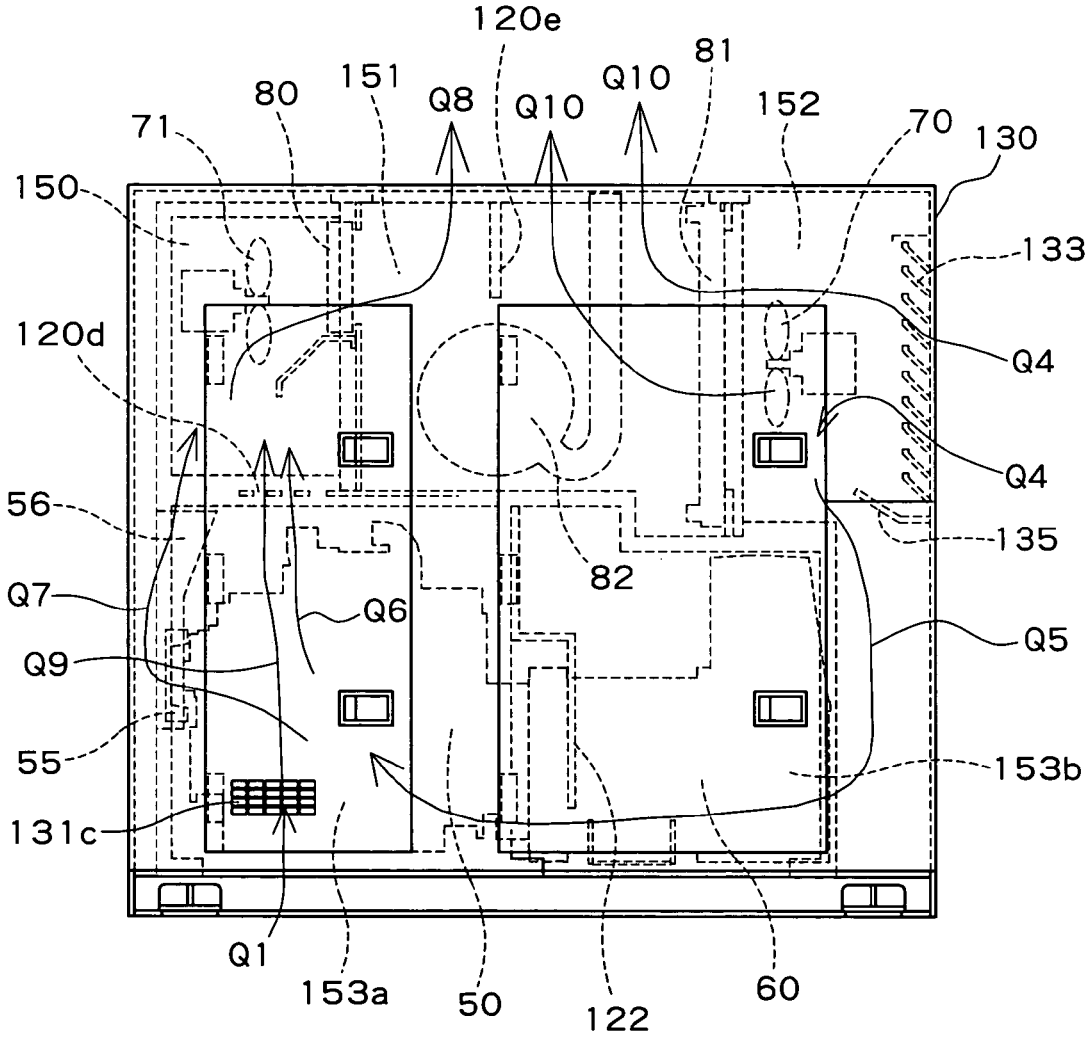
FIG. 5 is a diagram illustrating the flow of cooling wind using FIG. 1.

FIG. 5 is a diagram of the flow of the cooling wind, using the side view of the soundproof engine-driven operating machine shown in FIG. 1. Cooling wind Q4 enters the first cooling fan 70 through an outwardly-facing intake hole 133 in the top right side of the cover 130 in FIG. 5, cools the first heat exchanger 81 and the inside of the muffler section 151, and is then bent upwards by the wind outlet guide plate 120*e* and discharged into the atmosphere as flow Q10.

The cooling wind Q4 is fed into the second cooling fan 71 and the engine fan 55 from the intake hole 133 at the top right side of the cover 130 as viewed in FIG. 5, where it becomes cooling wind Q5, flowing downwards from the first heat exchanger section 152 and changing direction into the generator container 153*b*. The cooling wind Q5 passes below the dividing plate 122, and enters the engine container 153*a*.

A shut-off plate 134 is provided below the intake holes 133, and prevents noise, generated by the engine container 153*a* and the generator container 153*b*, from leaking to the outside through the intakes holes 133.

After cooling the engine container 153*a*, the cooling wind passes through a connecting hole 120*d* in the floor plate 120*a* of the structural frame 120, and becomes cooling wind Q6 that is sucked into the second heat exchanger section 150. Some of the cooling wind in the engine container 153*a* is sucked into the engine fan 55, and becomes cooling wind Q7 that passes along the ventilation duct 56 into the second heat exchanger section 150. Since the engine fan 55 is a centrifugal fan, its axial length can be made short, enabling the floor area of the engine-driven operating machine to be reduced.

Cooling wind Q1 is sucked through the intake holes 131*c* in the doors 131 by the second cooling fan 71, becoming cooling wind Q9 that flows along an unillustrated ventilation path 131*a* directly into the second heat exchanger section 150.

All of the cooling wind that is sucked into the second heat exchanger section 150 cools the second heat exchanger 80, is then sent to the muffler section 151 and cools the muffler 82. The direction of the cooling wind is then changed by the wind outlet guide plate 120*e*, so that the wind becomes discharge wind Q8 that passes through an unillustrated wind outlet hole in the cover 130 and is released into the atmosphere. The wind outlet guide plate 120*e* allows the wind to be discharged smoothly without collision.

The corner-less flow of cooling wind inside the case enables the various devices inside the case (i.e. the engine, the operating machine main body, the heat exchangers, and the muffler) to be efficiently cooled in sequence. Cooling wind that contains heat produced by the cooling effect is then discharged into the atmosphere from the wind outlet hole by the sealed structure of the flexible member, that surrounds the top of the muffler chamber and the four corners of the inner face of the wind outlet holes in the cover 130.

EMBODIMENT 2

Figure 6:
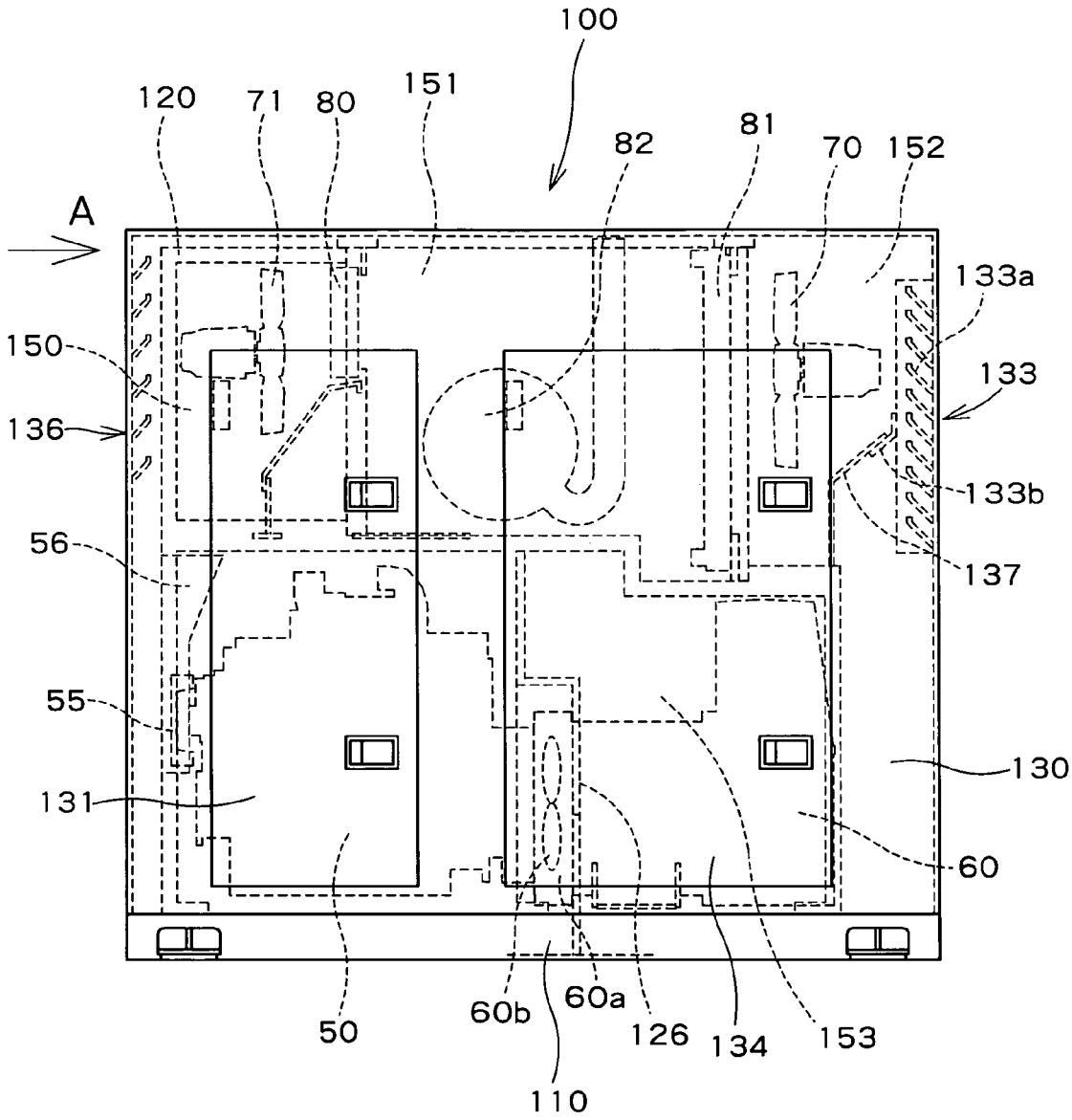
FIG. 6 is a side view of the constitution of another embodiment of the invention.

FIG. 6 is a side view of the present invention according to the second embodiment. According to the second embodiment, in order to strengthen the cooling function of the invention, a second cooling fan 71 sucks in air from the side of a second-storey chamber, as opposed to sucking in air from the side of a first-storey chamber as in the first embodiment.

In other words, the second cooling fan 71 sucks in air mainly from intake holes 136, and cools a second heat exchanger 80 along with cooling air passing through a ventilation duct 56 from the first-storey chamber and the cooling air passing through a connect hole 120*d*. As a result, all the parts of the first-story chamber are cooled, and the cooling efficiency is improved due to the direct intake of the main cooling winds from the intake holes 136.

Figure 7:
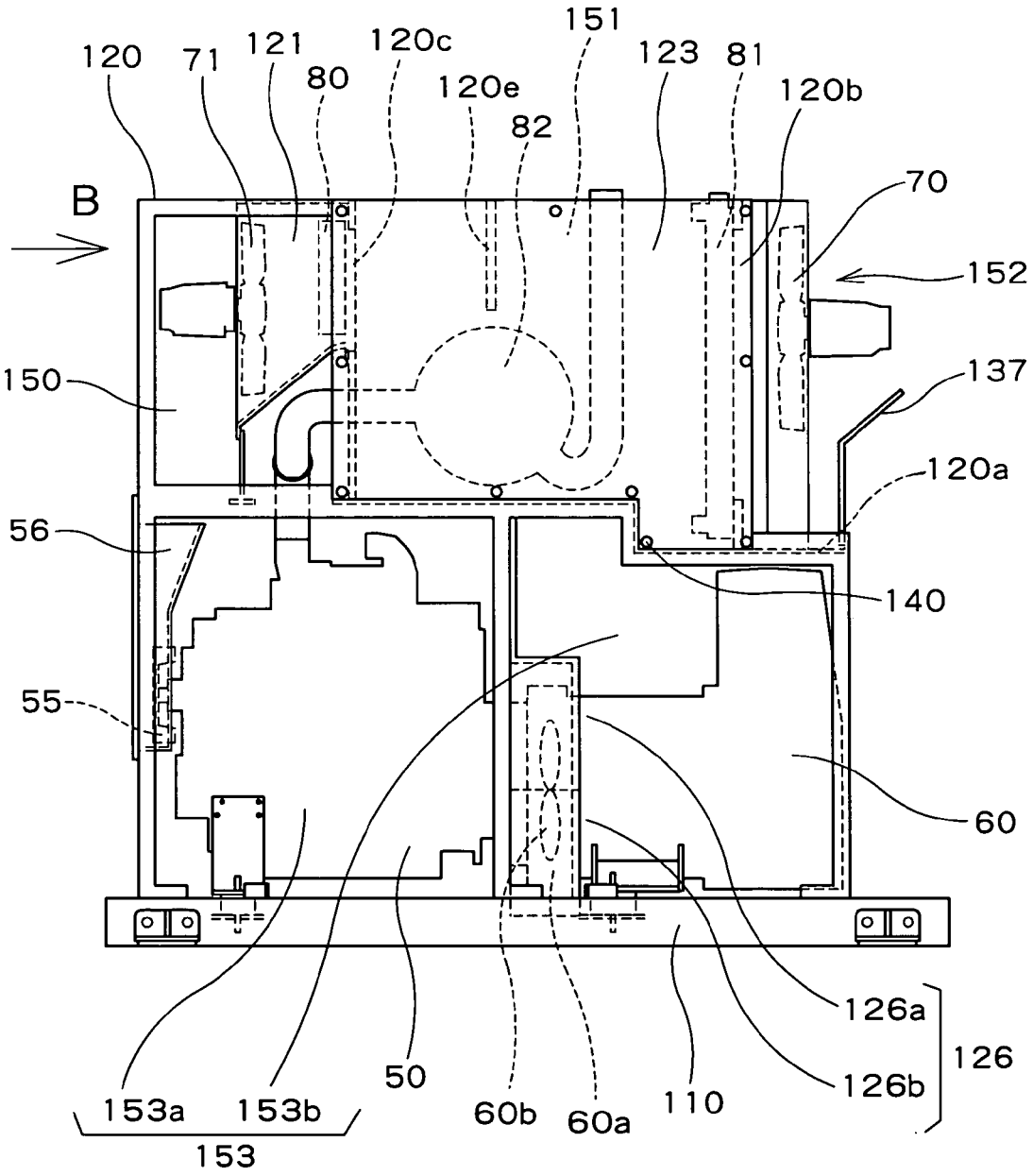
FIG. 7 is a side view of the internal structure of the other embodiment of the invention shown in FIG. 6.

FIG. 7 illustrates the second embodiment of FIG. 6 with a cover 130 removed. It can be understood from FIG. 7 that both the second cooling fan 71 and the first cooling fan 70 have been strengthened, as compared with the embodiment shown in FIG. 1.

Due to these improvements, strong cooling winds can be generated from the first and second cooling fans 70, 71. In addition, in the first-storey chamber, a cooling wind is formed by a cooling fan 60*a* of a generator 60, and then the cooling wind flows out from the right side of the diagram to the left side, towards the second-storey chamber. Further, a dividing plate 126 completely divides off an engine container 153*a* and a generator container 153*b* in order to prevent the transmission of noise.

Figure 8:
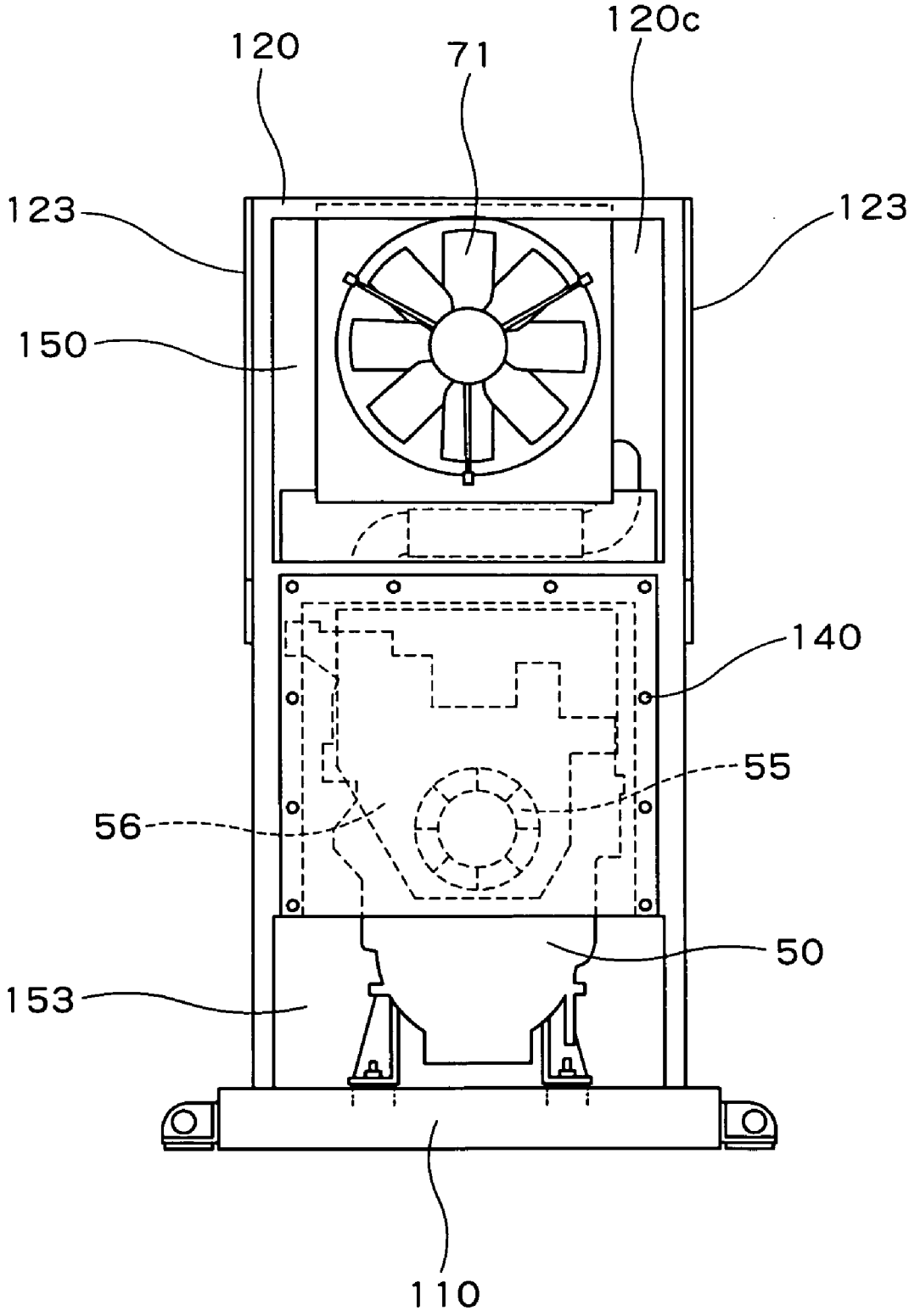
FIG. 8 is a view of direction B of FIG. 7.

FIG. 8 is a side view of FIG. 7 from the direction B. On the top of the diagram, the second cooling fan 71 is illustrated, and the bottom of the diagram shows in broken lines an engine fan 55, which is disposed on an engine 50 and sends cooling wind to the ventilation duct 56.

Figure 9:
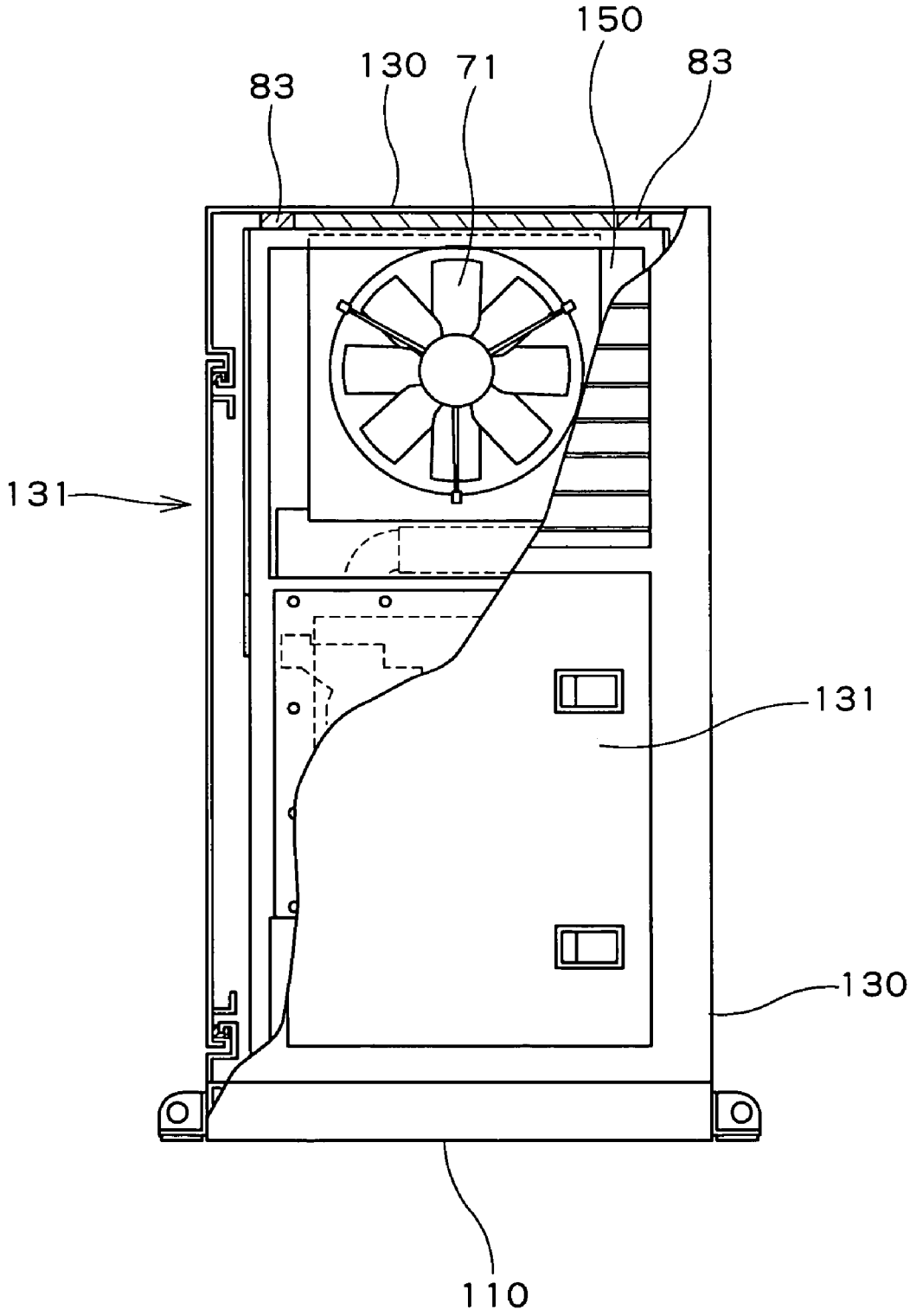
FIG. 9 is a side view of direction A of FIG. 6.

FIG. 9 is a side view of FIG. 6 from the direction A with one section broken out. Doors 131 have been made smaller and are disposed on the lower portion in the diagram, and there are no intake holes in the door. Instead, intake holes are arranged in the cover 130 above the doors 131, opposite the second cooling fan 71.

Figure 10:
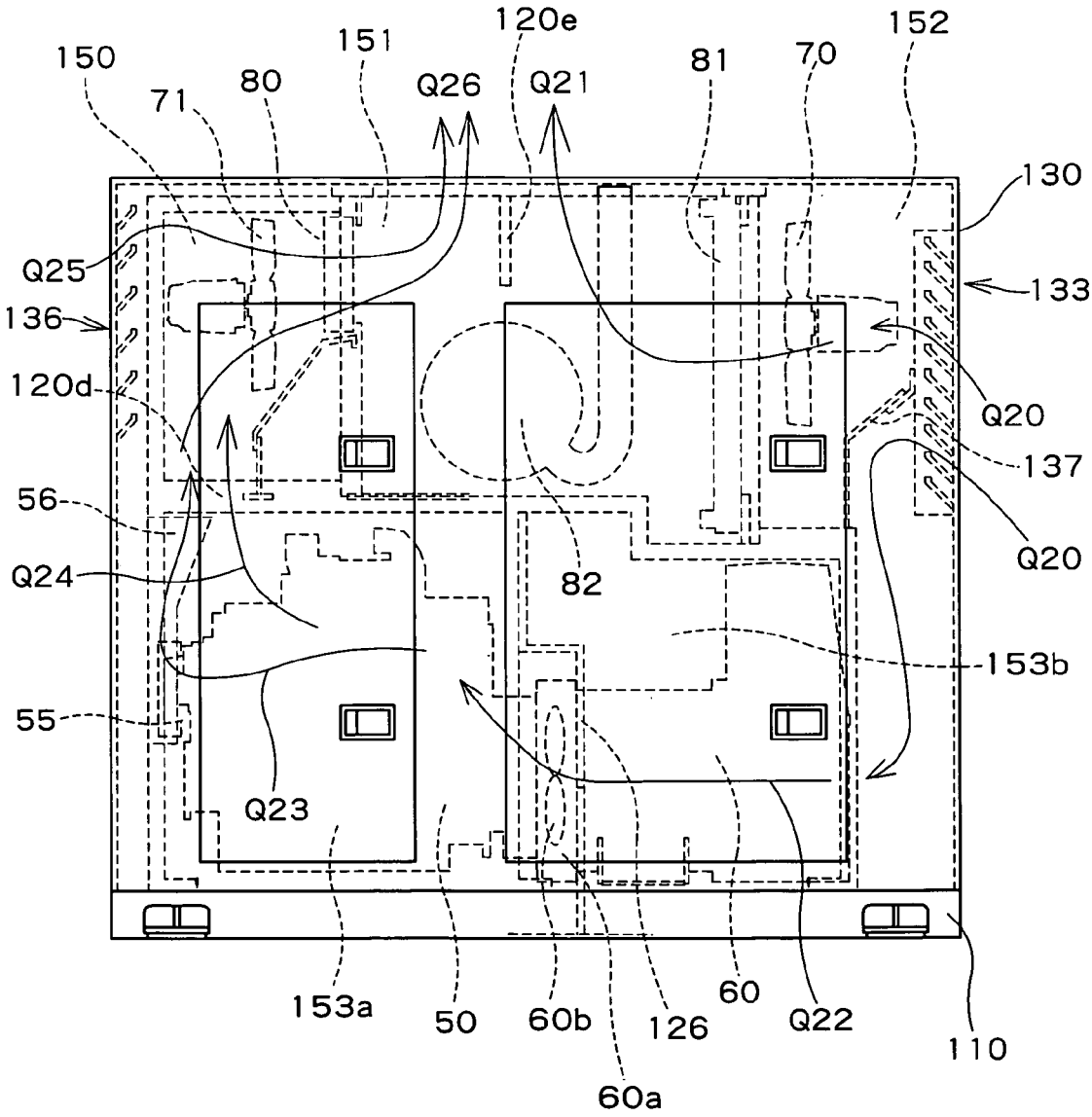
FIG. 10 shows the flow of cooling winds using FIG. 6.
Figure 11:
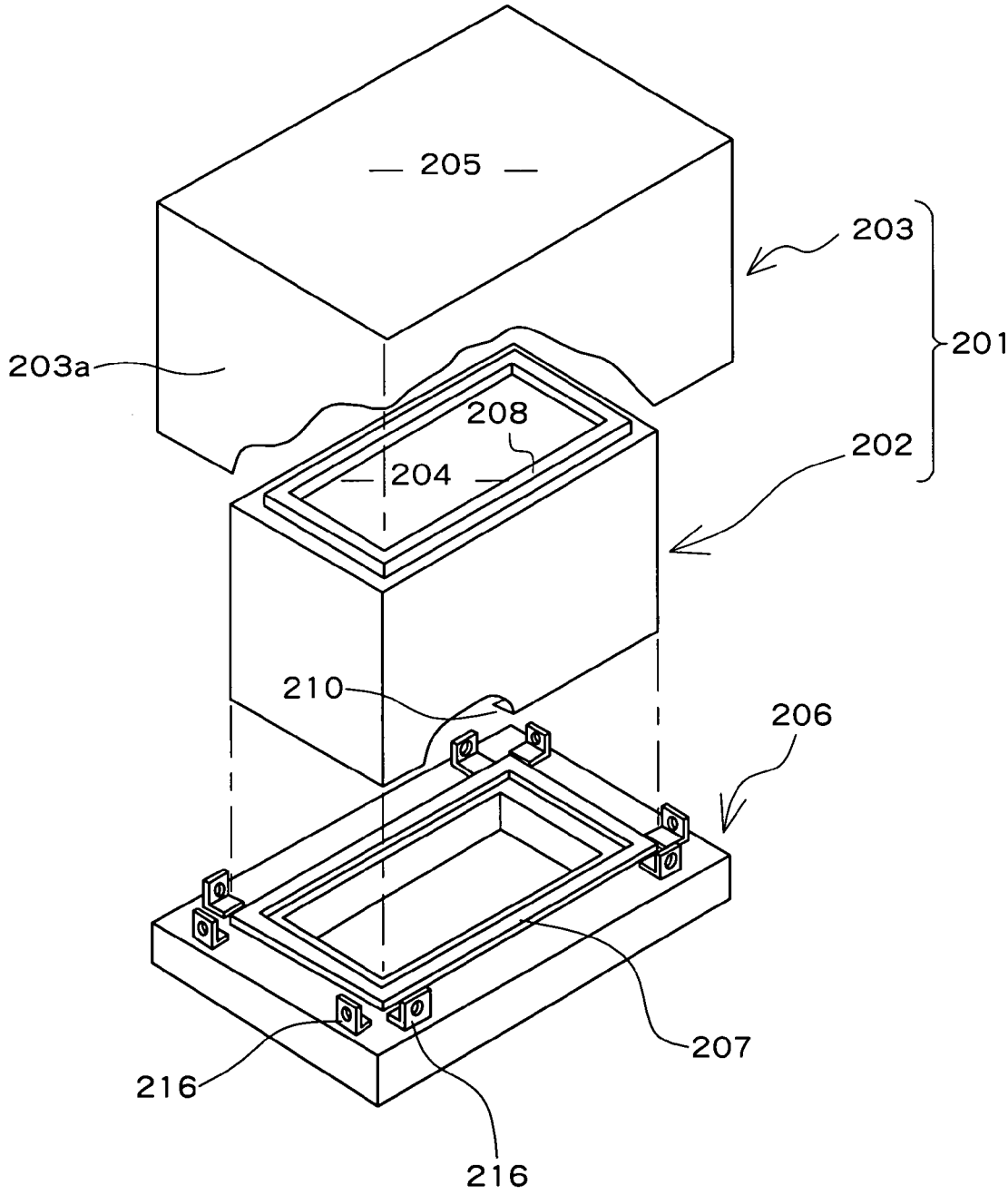
FIG. 11 is a perspective view of a conventional soundproof case.
Figure 12:
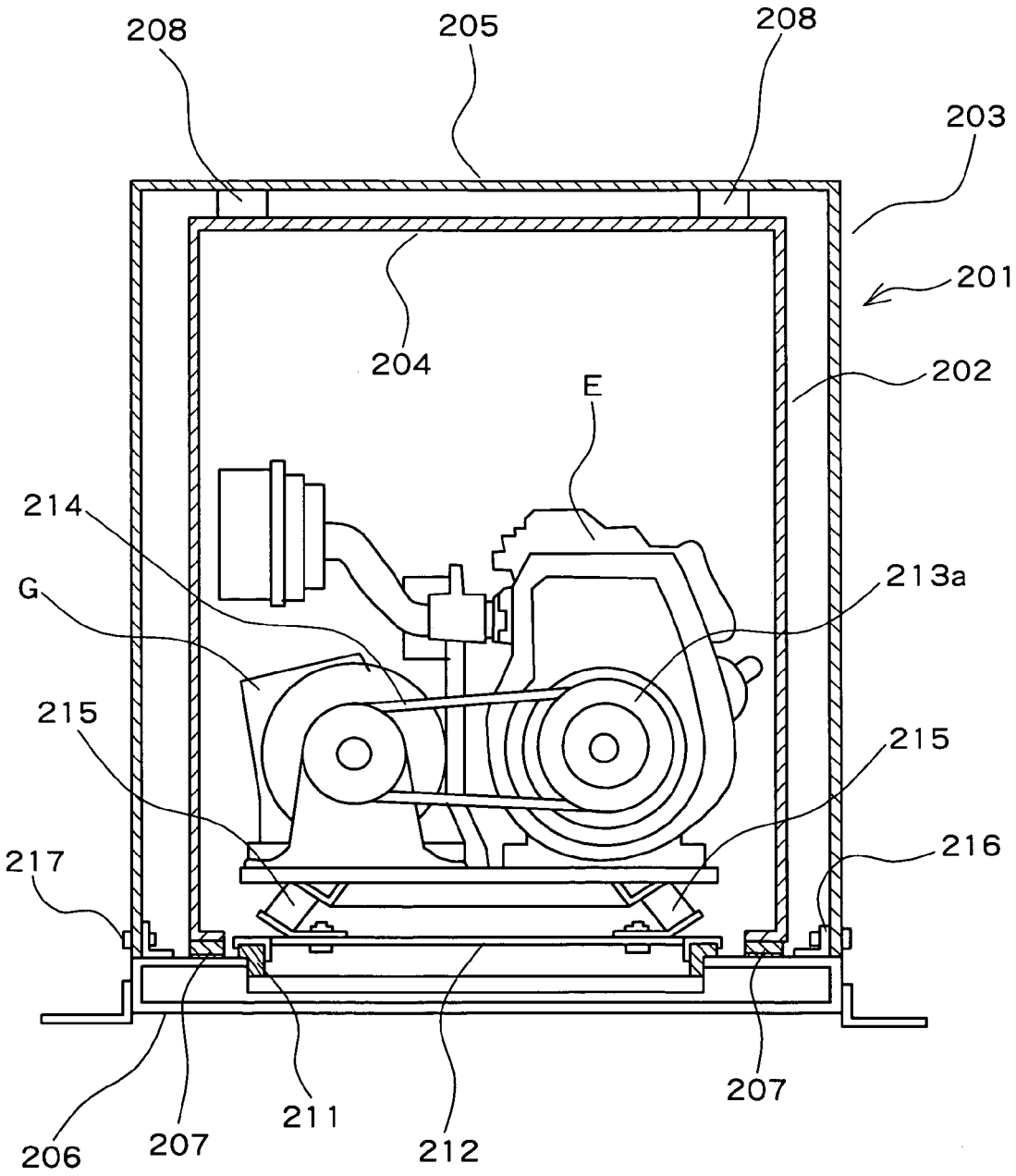
FIG. 12 is a vertical cross-sectional view of a conventional soundproof case.
Figure 13:
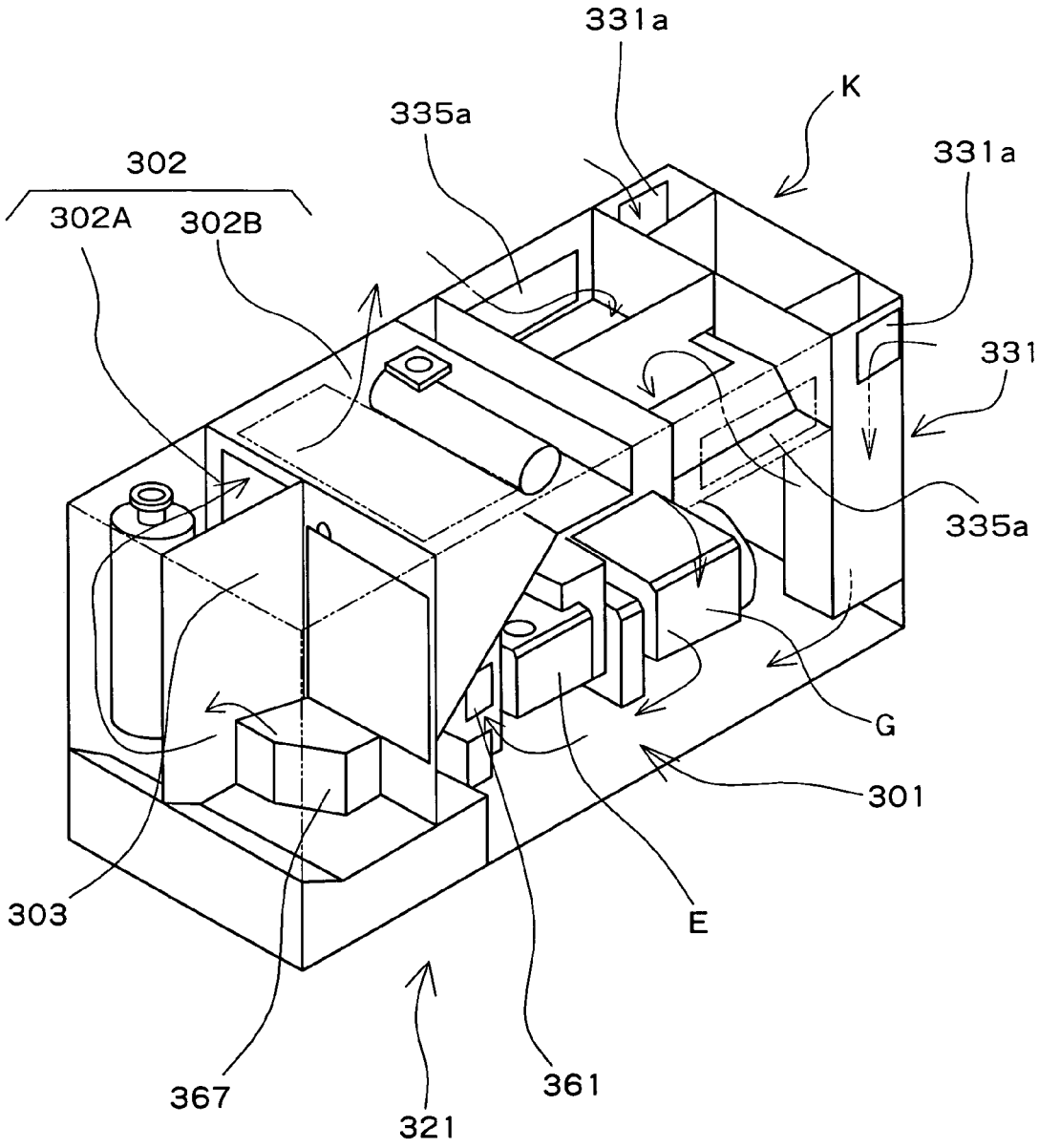
FIG. 13 is a perspective view of the constitution of another conventional soundproof engine-driven operating machine.

FIG. 10 shows the entire flow of the cooling winds using FIG. 6. As shown in FIG. 10, the cooling winds flow from the right side to the left side of the first-storey chamber, then flow upwards to the second-storey chamber where the winds join the intake from the left and right sides of the cover 130 and escape outside through the top.

In other words, a cooling wind Q20 is guided through intake holes 133 via the guide plate 137 and into the first-storey chamber. The cooling wind Q20 becomes a cooling wind Q22 as it passes through an operating machine main body 60 and the cooling fan 60*a*. Cooling wind Q22 then becomes cooling winds Q23 and Q24 after passing the engine 50. Cooling winds Q23 and Q24 pass through the ventilation duct 56 and the connect hole 56, respectively, in entering the second-storey chamber.

In the second-story chamber, cooling winds Q20 and Q25, which were sucked in through the intake holes 133, 136, respectively, are converged into the center by the first and second cooling fans 70, 71 and then discharged outside into the air as discharged winds Q21 and Q26.

What is claimed is:

1. A soundproof engine-driven operating machine comprising:

an engine;

an operating machine main body driven by the engine;

a base frame supporting the engine and the operating machine main body in a vibration-proof structure;

a case fitted to the base frame and accommodating the engine and the operating machine main body;

part of the case including a first-story chamber accommodating the engine and the operating machine main body, first and second heat exchangers, each having a cooling fan and being arranged above the first-story chamber, the first and second heat exchangers performing heat conversion relating to the operation of the engine by using the cooling fans, arranged separately in a ventilation path, and a second-story chamber accommodating a muffler for discharging engine air, the part of the case being comprised from a structural frame provided on the base frame;

the first-story chamber and the second-story chamber being connected by a ventilation path supplying cooling wind for the second heat exchanger from the first-story chamber;

the second-story chamber having a ventilation path discharging cooling winds, passing through the first and second heat exchangers and cooling the muffler, to the outside.

2. The engine-driven operating machine according to claim 1, wherein the engine has a centrifugal fan at the end of a rotating axis, driven by a pulley and a fan belt using a crank axis;

the centrifugal fan is enclosed by a wind duct, having an inlet facing the engine and a outlet facing the second heat exchanger.

3. The engine-driven operating machine according to claim 1, further comprising a partition extending over the outer periphery of the operating machine main body, and forming a ventilation path between the bottom and both sides of the operating machine main body.

4. The engine-driven operating machine according to claim 1, further comprising a cover secured to the base frame, and covering the structural frame forming part of the case.

5. The engine-driven operating machine according to claim 4, wherein a side wall of the cover has an inlet hole for supplying cooling wind to the first heat exchanger and the second heat exchanger, a top face of the cover has an outlet hole discharging exhaust wind from the muffler to the outside, and the inside of the top face of the cover has a flexible member directly contacting the top of the structural frame.

6. The engine-driven operating machine according to claim 4, wherein the cover has a door containing a ventilation duct, the ventilation duct having at one end an inlet hole connecting to the outside, and, at another end, an outlet hole connecting to the inside of the structural frame.

7. The engine-driven operating machine according to claim 1, wherein the cooling fan is arranged to suck in air from the side of the second-story chamber.

* * * * *

UNITED STATES PATENT AND TRADEMARK OFFICE

CERTIFICATE OF CORRECTION

PATENT NO. : 7,107,943 B2
APPLICATION NO. : 11/050650
DATED : September 19, 2006
INVENTOR(S) : Yasuda et al.

It is certified that error appears in the above-identified patent and that said Letters Patent is hereby corrected as shown below:

On the title page, item (73) Assignee, change “Denko” to --Denyo--.

Signed and Sealed this

Second Day of January, 2007

JON W. DUDAS
*Director of the United States Patent and Trademark Office*